US010751773B2

(12) United States Patent
Karhausen et al.

(10) Patent No.: US 10,751,773 B2
(45) Date of Patent: Aug. 25, 2020

(54) METHOD AND APPARATUS FOR ROLL-EMBOSSING A STRIP

(71) Applicants: Kai-Friedrich Karhausen, Bonn (DE); Gernot Nitzsche, Meckenheim (DE)

(72) Inventors: Kai-Friedrich Karhausen, Bonn (DE); Gernot Nitzsche, Meckenheim (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 0 days.

(21) Appl. No.: 15/668,789

(22) Filed: Aug. 4, 2017

(65) Prior Publication Data

US 2017/0355002 A1 Dec. 14, 2017

Related U.S. Application Data

(63) Continuation of application No. PCT/EP2016/051556, filed on Jan. 26, 2016.

(30) Foreign Application Priority Data

Feb. 4, 2015 (DE) ..... 10 2015 101 580

(51) Int. Cl.
*B21B 1/22* (2006.01)
*B21B 3/00* (2006.01)
(Continued)

(52) U.S. Cl.
CPC ..... *B21B 1/227* (2013.01); *B21B 27/005* (2013.01); *B21B 45/0251* (2013.01);
(Continued)

(58) Field of Classification Search
CPC ..... B21B 1/227; B21B 39/10; B21B 39/04; B21B 39/08; B21B 39/084;
(Continued)

(56) References Cited

U.S. PATENT DOCUMENTS 2,192,044 A * 2/1940 Lessmann ..... B21B 37/50 72/12.4
4,187,707 A * 2/1980 Quehen ..... B21B 37/46 72/10.7
(Continued)

FOREIGN PATENT DOCUMENTS

DE 195 29 429 C2 10/1999
DE 44 24 613 B4 3/2007
(Continued)

OTHER PUBLICATIONS

R. V. Singh, "Aluminium Rolling—Processes, Principles and Applications", Tata McGraw Hill Education Private Limited, vol. ch. 4, 2011, pp. 149-186, 373-397, ISBN 978-1-25-900573-9, 48 pages.
(Continued)

*Primary Examiner* — Pradeep C Battula
(74) *Attorney, Agent, or Firm* — Reinhart Boerner Van Deuren P.C.

(57) ABSTRACT

Provided is a method for rolling a strip with a roll stand with at least two work rolls. A rolling gap with a pass line is defined between the work rolls. A control roll is arranged before the rolling gap of the work rolls in the rolling direction, the strip is guided into the rolling gap of the roll stand via the control roll at an entry angle relative to the pass line and the surface structure of the strip is controlled through the selection of the entry angle depending on the positioning of the control roll relative to the pass line. Also provided is an apparatus for rolling a strip with a roll stand having at least two work rolls. A rolling gap with a pass line is defined between the work rolls.

15 Claims, 7 Drawing Sheets

(51) Int. Cl.
*B21B 27/00* (2006.01)
*B21B 45/02* (2006.01)

(52) U.S. Cl.
CPC ..... *B21B 2003/001* (2013.01); *B21B 2261/14* (2013.01); *B21B 2265/14* (2013.01); *B21B 2265/24* (2013.01)

(58) Field of Classification Search
CPC ..... B21B 2273/02; B21B 39/16; B21B 39/14; B21H 8/005; B44B 5/0047; B44B 5/009
See application file for complete search history.

(56) References Cited

U.S. PATENT DOCUMENTS

| | | | | | |
|---|---|---|---|---|---|
| 4,307,591 | A * | 12/1981 | Peterson | B21B 37/50 | 226/25 |
| 4,507,946 | A * | 4/1985 | Koyama | B21B 37/50 | 72/205 |
| 4,627,258 | A * | 12/1986 | Loges | B21D 13/04 | 72/196 |
| 5,660,066 | A * | 8/1997 | Asano | B21B 37/50 | 72/11.4 |
| 5,701,774 | A * | 12/1997 | Imanari | B21B 37/50 | 72/11.4 |
| 6,619,086 | B1 * | 9/2003 | Ikeda | B21B 37/50 | 700/152 |
| 2004/0148994 | A1 | 8/2004 | Schwarz et al. | | |
| 2010/0024513 | A1 * | 2/2010 | Kawai | B21B 1/227 | 72/365.2 |
| 2012/0000213 | A1 * | 1/2012 | Lin | B21B 45/0209 | 62/64 |
| 2012/0324971 | A1 * | 12/2012 | Simaan | B21B 37/50 | 72/7.4 |
| 2013/0331977 | A1 * | 12/2013 | Mecev | B21B 37/50 | 700/170 |
| 2015/0321232 | A1 * | 11/2015 | Stewart | B21B 1/227 | 29/428 |

FOREIGN PATENT DOCUMENTS

| | | | | |
|---|---|---|---|---|
| EP | 0 908 248 | A2 | | 4/1999 |
| EP | 1 344 580 | A1 | | 9/2003 |
| GB | 1147986 | B3 | | 4/1969 |
| GB | 2 072 556 | A | | 10/1981 |
| GB | 2 144 666 | A | | 3/1985 |
| JP | 55-165217 | A | | 12/1980 |
| JP | 2-169109 | A | | 6/1990 |
| JP | 03035805 | A | * | 2/1991 |
| JP | 09-164435 | A | | 6/1997 |
| JP | H10-94803 | A | | 4/1998 |
| JP | 10-137869 | A | | 5/1998 |
| JP | 10166001 | A | * | 6/1998 |
| JP | 2000-94005 | A | | 4/2000 |
| JP | 2001-353509 | | * | 12/2001 |
| JP | 2005-500164 | A | | 1/2005 |
| WO | WO 03/018221 | A2 | | 3/2003 |
| WO | WO 2009/020587 | A1 | | 2/2009 |
| WO | WO 2011/006851 | A1 | | 1/2011 |
| WO | WO 2014/013471 | A1 | | 1/2014 |

OTHER PUBLICATIONS

Davy-Loewy Limited, "Four-high non-reversing pure hydraulic cold strip rolling mill for A/S Nordisk Aluminiumindustri", Holmestrand Norway, Lowey Robertson Engineering Company Limited, 1973, 2 pages.

H. F. Atala et al., "Surface Roughness Changes During Rolling", Elsevier Sequoia S.A., Lausanne, wear 32, 1975, pp. 249-268, 20 pages.

Patrick Deneuville, "Matériaux—Mise en forme de l'Aluminium-Laminage", Techniques de l'Ingénieur, Ref. M3140, vol. 1, Jun. 10, 1010, 27 pages.

G. Moreas et al., "Advanced Sensor for On-Line Topography in Continuous Lines", La Revue de Metallurgie—CIT, May 2006, pp. 233-237, 5 pages.

* cited by examiner

METHOD AND APPARATUS FOR ROLL-EMBOSSING A STRIP

CROSS-REFERENCE TO RELATED PATENT APPLICATIONS

This patent application is a continuation of PCT/EP2016/051556, filed Jan. 26, 2016, which claims priority to German Application No. 10 2015 101 580.3, filed Feb. 4, 2015, the entire teachings and disclosure of which are incorporated herein by reference thereto.

FIELD OF THE INVENTION

The invention relates to a method for roll-embossing a strip with a roll stand comprising a first work roll and a second work roll, wherein a rolling gap with a pass line is defined between the first work roll and the second work roll. The invention further relates to an apparatus for roll-embossing a strip, in particular for carrying out a method according to the invention, with a roll stand comprising a first work roll and a second work roll, wherein a rolling gap with a pass line is defined between the first work roll and the second work roll.

BACKGROUND OF THE INVENTION

During manufacture, rolled strips and sheets can be provided with a particular surface structure in a final rolling pass, in particular a final cold rolling pass. A roll stand is thereby used in which at least one of the work rolls of the roll stand has a defined surface structure which is impressed in the surface of the strip or sheet by the rolling pass.

A surface structure of this type can prepare the strip or the sheet for a particular form of further processing. Particularly in automotive engineering, but also in other fields of application, for example aircraft construction or rail vehicle construction, metal sheets are required which exhibit a very good forming behaviour and which make high degrees of deformation possible. In automotive engineering, typical fields of application include bodywork and chassis components. Moreover, in the case of visible, painted components, for example externally visible bodywork panels, the materials must be formed in such a way that the surface is not affected by faults such as slip lines or roping after spraying. This is for example particularly important in the case of metal sheets used to produce engine bonnets and other bodywork components of a motor vehicle.

Only slight pass reductions take place during a roll-embossing pass. The forming behaviour of the strip with the specific surface structure introduced through the roll-embossing pass, in other words the rolling pattern created through the embossment rolling, is also advantageously influenced through the embossing pass. For example, if the strip, or a sheet produced from the strip, is formed during the course of further processing, the surface structure of the strip introduced during rolling reduces the friction between sheet and forming tool. In particular, the surface structure is preferably designed such that the sheet can be wetted more effectively with lubricants during forming. The surface can have depressions in the form of lubrication pockets which can hold lubricants. This further reduces the frictional forces during forming and makes higher degrees of deformation possible.

However, in order to achieve this, there must be a possibility of adjusting the surface structure of the strip or the rolling pattern. During rolling, particularly during roll-embossing with low pass reductions, it is in particular difficult to ensure a consistently uniform impression of the surface structure of the work rolls, in particular on both sides of the strip. One problem is that the work rolls of the roll stand are subject to wear, and thus during continuous operation have a surface structure which changes over time. In addition, the surface structure of the work rolls can, over time, pick up material from the strip or impurities and consequently lead to a rolling pattern which can change over time. On the other hand, the strip which is fed into the roll stand is usually subject to fluctuations, which makes it difficult to achieve a uniform rolling pattern. The fed strip can for example vary in dimensions such as thickness, width or also curvature, or in profile or also in strength, which in turn also allows the rolling pattern to vary during rolling.

Furthermore, in order to achieve a uniform surface structure of the strip on both sides it is in practice often necessary, depending on the rolling conditions and the stand design in a rolling train, to use different work rolls for the upper side and underside, in particular work rolls with different surface topographies. This complicates the provision of corresponding work rolls for the roll stand.

Therefore, in DE 44 24 613 B4 a roll stand is suggested which can be controlled with respect to the surface roughness of the produced strip. This control is effected by means of bending equipment on the work rolls which can control the bending of the work rolls and thus the surface structure over the width of the strip. However, one disadvantage here is that corresponding roll stands equipped with bending equipment are complicated in structure and thus less economical. In addition, a control of the surface structure is only possible over the width of the strip. Adjustment of the surface structure on the upper side and underside of the strip, for example in order to take into account different degrees of wear or grinding of the work rolls, is not possible.

An apparatus and a method for rolling a strip is also described in EP 0 908 248 A2 in which the upper side and underside of the strip and the respective work rolls are supplied with lubricant via separately controllable spraying devices. Any differences in the rolling pattern of the upper side and underside of the strip can be reduced through the dosing of the lubricant. This apparatus and this method are in need of improvement, in particular with regard to process reliability.

The present invention is therefore based on the technical problem of providing a method and an apparatus for rolling in which the surface structure of a strip can be controlled on the upper side and underside in a process-reliable manner and the disadvantages of the prior art avoided.

BRIEF SUMMARY OF THE INVENTION

According to a first technical teaching of the present invention, this technical problem is solved through a method for rolling a strip in that a control roll is arranged before the rolling gap of the work rolls in the rolling direction, the strip is guided into the rolling gap of the roll stand via the control roll at an entry angle β relative to the pass line and the surface structure of the strip is controlled through the selection of the entry angle β depending on the positioning of the control roll relative to the pass line.

The roll stand used in the method according to the invention has a first work roll and a second work roll. As the method is carried out, the work rolls come into contact with the strip, for example the first work roll is in contact with the upper side of the strip and the second work roll is in contact with the underside of the strip. In this case, at least one of the work rolls has a structured surface. On passing the strip through the rolling gap between the work rolls, the thickness of the strip is reduced and a corresponding structured rolling pattern is impressed on the surface of the strip through the at least one work roll with a structured surface. Preferably, a cold rolling pass is performed with the roll stand. A lubricant is usually used during rolling in the roll stand.

Usually, the two work rolls are used with parallel axes. In this case the axes of rotation lie parallel above one another and, together with connecting lines between the axes of rotation arranged perpendicular to the axes of rotation, form the outlet plane of the rolling gap.

The surface normal of the outlet plane of the work rolls in the neutral surface of the strip to be rolled is referred to as the pass line. If the strip is introduced into the rolling gap perpendicular to this outlet plane, it has an entry angle $\beta=0°$ relative to the pass line. The entry angle $\beta$ is thus determined relative to the surface normal of the outlet plane. If the strip intake is tilted relative to the surface normal of the outlet plane, the entry angle $\beta$ has values which are not equal to zero.

According to the invention, the strip is guided into the rolling gap of the roll stand via a control roll. The entry angle $\beta$ is thereby altered through a positioning of the control roll relative to the pass line and in this way the transfer of the surface structure onto the strip controlled. It has been recognised that changing the entry angle $\beta$ through the positioning of a control roll represents a simple and reliable possibility for controlling the surface structure of the strip in a roll-embossing pass. By changing the entry angle $\beta$, the rolling pass can be adjusted with respect to the desired surface structure without changing the roll stand or having to adapt other equipment installed before the roll stand, for example guide rolls, specifically to change the entry angle $\beta$. In particular, a replacement of the work rolls when a certain degree of wear occurs can often be dispensed with, since under certain conditions it is also possible only to influence the embossing on one side of the strip. Despite the work roll becoming worn, the rolling pattern can be kept uniform through a regulation of the entry angle $\beta$ by means of the control roll. Also, simple work rolls without a bending apparatus can be used to change the rolled section. In particular, two work rolls with unequal surface roughnesses can be used to produce a strip with the same surface roughness on both sides. Also, an existing rolling train can be upgraded with a positionable control roll and thus the scope of use of the existing rolling train expanded in a simple manner.

The technical effect of the positioning of the control roll or the changing of the entry angle $\beta$ is based in particular on controlling the lubricant feed into the rolling gap. The lubricant feed is substantially determined through three contributions. These are

- the feed through surface-active substances which actively bind lubricant to the surface of the work rolls and/or the strip,
- the feed through geometrical conditions on the surface of the work rolls and of the strip, in particular the surface roughness and the resulting lubrication pockets and
- the hydrodynamic feed.

The hydrodynamic feed makes the dominant contribution to the lubricant feed. This is dependent on the contact angle between the surface of the respective work roll and the surface of the strip. By changing the entry angle $\beta$, the contact angle of the work roll and thus the hydrodynamic lubricant feed can be changed. In particular, by changing the entry angle, influence can be exerted on the rolling pattern of the upper side and underside of the strip, for example in order to achieve a uniform rolling pattern on both sides and in order to react to different surface structures and different degrees of wear of the surface structure of the two work rolls.

The lubricant feed in the roll stand on the upper side and the underside of the strip, and therefore also the rolling pattern, can thus be directly influenced by a corresponding positioning of the control roll relative to the pass line.

According to a first embodiment an entry angle $\alpha$ is preferably set within an adjustment range of $+/-2\alpha$, where $\alpha$ is the bite angle of a work roll (2, 4) in a given rolling pass, for which:

$$\alpha=\arccos\,[1-(\Delta h/DW)],$$

where $\Delta h$ is the difference between the thickness of the strip before rolling and the thickness of the strip after rolling in mm (pass reduction) and DW is the diameter of the work roll (2, 4) in mm. On the one hand, the use of a correspondingly limited adjustment range for the angle $\beta$ covers the relevant angle range and, on the other hand, makes it possible to achieve a very fine adjustment of the angle within the range.

At an entry angle $\beta$ above this bite angle $\alpha$, on being fed in the strip already lies tangentially against the surface of the respective work roll before the strip is deformed in the rolling gap. In a preferred embodiment of the method according to the invention, an entry angle $\beta$ greater than the bite angle $\alpha=\arccos\,[1-(\Delta h/D_W)]$ of a work roll is therefore selected, where $\Delta h$ is the difference between the thickness of the strip before rolling and the thickness of the strip after rolling in mm (pass reduction) and $D_W$ is the diameter of the work roll in mm. During roll-embossing in particular, smaller pass reductions $\Delta h$ are usually provided, as a result of which the bite angle $\alpha$ becomes correspondingly small.

If a work roll is operated with an entry angle $\beta$ greater than the bite angle $\alpha$, then when the entry angle $\beta$ is changed the rolling pattern only changes on a first side of the strip, since the other side is in contact with the work roll with a contact angle above the angle of bite. This means that by changing the feed angle $\beta$ the rolling pattern of the second side of the strip can be adjusted practically independently of the first side. Consequently, in this design in particular a uniform rolling pattern can be provided on both sides of the strip with a simplified control. The entry angle $\beta$ is preferably changed in 0.1° increments, particularly preferably in 0.05° increments, so that a very precise influencing of the surface roughness of the upper side and underside of the strip can be achieved.

The surface topography of rolled strips is particularly dependent on the surfaces of the work rolls. However, the surface roughness of the two work rolls can be different. The properties of a surface topography can be determined by means of different characteristic values. A usual characteristic value is the mean roughness value $R_a$ according to DIN EN ISO 4287 and DIN EN ISO 4288. This characteristic value is defined by the following equation:

$$R_a=1/L\int|Z(x)|dx \tag{2}$$

Z(x) is a profile of the surface, in other words a one-dimensional section through the function Z(x,y). L is the length of the integration interval. In practice, in order to determine the surface quality of a surface, one-dimensional profiles Z(x) are measured at different positions on the surface through linear scanning and the corresponding value $R_a$ is determined.

The value for $S_a$ is derived from a two-dimensional measurement of the surface, that is to say the topography Z(x,y). The value $S_a$ is calculated on the basis of the following equation, where A is the size of the integration surface:

$$S_a=1/A\iint|Z(x,y)|dxdy \quad (3)$$

The roughness $R_a$ or $S_a$ of the surfaces of the work rolls can for example lie within the range from at least 0.1 μm to a maximum of 10.0 μm, preferably at least 0.4 μm to a maximum of 4.0 μm, particularly preferably at least 0.6 μm to a maximum of 3.0 μm. The difference in the roughness $R_a$ or $S_a$ of the surfaces of the work rolls can, in particular in connection with an entry angle β, amount to more than 0.1 μm, in particular more than 0.3 μm. It is also conceivable that a structured surface is only present in one of the work rolls.

With two different roughnesses of the surface of the work rolls, the entry angle β can for example be adjusted so that the contact angle between the less rough work roll and the strip exceeds the bite angle α and thus this side of the strip experiences a rolling pattern which is practically independent of any further changing of the entry angle β. In this case the rolling pattern of the side of the strip which is in contact with the rougher work roll can be controlled by means of the entry angle β.

In a further embodiment of the method according to the invention, at least one guide roll is used through which the strip runs before the control roll. A guide roll or an arrangement of several guide rolls serves to guide the strip and to regulate the tension on the strip, wherein in particular the strip runs through several guide rolls and is alternately bent between these. In combination with the control roll, at least one guide roll offers the possibility of pre-setting the entry angle β so that the entry angle β can be adjusted in very small angular increments by means of the control roll and at the same time it is ensured by means of the at least one guide roll that the control roll has sufficient traction and surface damage to the strip can be avoided.

In a further embodiment of the method according to the invention, the at least one guide roll is positioned such that an entry angle $\beta_B$ is set by means of the at least one guide roll if the control roll does not touch the strip and an entry angle β is set through the positioning of the control roll, wherein the difference between the entry angles β and $\beta_B$ is at least 0.5°, preferably 1.0°. Without limiting the scope, for the purpose of better understanding, in the following, by way of example, an approximately horizontal pass line is assumed, whereby a negative entry angle β represents an entry of the strip from a position above the pass line and a positive entry angle β represents an entry of the strip from a position below the pass line. Firstly, without the control roll touching the strip, the at least one guide roll is positioned such that an entry angle $\beta_B$ is set. In this example, a control roll is located above the path of the strip, in other words the control roll is then positioned such that it touches the upper side of the strip. An entry angle β can now be set with the control roll, which is located between the guide roll and the roll stand. If the difference between the entry angles β and $\beta_B$ is at least 0.5°, preferably 1.0°, the control roll has sufficient traction on the strip to avoid slipping between the strip and the control roll. This avoids undesired grinding or scratching effects on the surface of the strip caused by the control roll.

In a further embodiment of the method according to the invention, a two-high roll stand is used as roll stand. Two-high roll stands are simple in structure and correspondingly economical. The use of a control roll before the two-high roll stand allows the rolling pattern on the strip to be controlled adequately well by means of the control roll despite the low angle of bite. This means that more complicated, maintenance-intensive and expensive four-high and six-high roll stands can be dispensed with.

In particular, a roll stand with two identical work rolls is used. The work rolls can thereby be of identical design in terms of diameter and length, but need not necessarily have the same structured surface, for example profiles with the same roughness. This makes the work rolls easily replaceable, since only one type of work roll needs to be provided. Any irregularities in the embossing onto the strip can be equalised with the method according to the invention by changing the entry angle β. This means that quality fluctuations in the preparation of the surfaces of the upper and lower rolls can also be equalised.

In a further embodiment of the method according to the invention, the surface roughness of at least one surface of the strip is controlled by adjusting the entry angle β through the positioning of the control roll during rolling in combination with a measurement of the surface roughness of the strip. Since the entry angle β can be changed through the positioning of the control roll, it is also possible to influence the entry angle β and thus the rolling pattern through a positioning of the control roll during ongoing rolling operation. In particular, the change in the entry angle β during rolling is determined through further process parameters, in particular measured values. A measurement of the surface roughness of the incoming and/or outgoing strip preferably takes place, more preferably on the upper side and underside of the strip. If changes or deviations in the surface roughness of the strip from a desired value are measured, a uniform rolling pattern can thus be achieved again by changing the entry angle β.

The roll stand and the control roll can be arranged inline or within a rolling train with preceding cold and hot-rolling roll stands. The control roll hereby makes a flexible adaptation of the roll-embossing pass to the process parameters of the rolling train or the preceding rolling passes possible.

In a further embodiment of the method according to the invention, a roll-embossing pass with a relative change in thickness of the strip (degree of reduction) of less than 10%, preferably 1 to 6% is carried out. As a result of the low degrees of reduction, the transfer of the surface structure of the roll is improved because the elongation is kept low. At the same time, hardening effects can be limited and thus the mechanical properties of the strip advantageously influenced. The roll-embossing pass is preferably carried out with work rolls with a diameter of at least 200 mm up to a maximum of 1200 mm.

In a further embodiment of the method according to the invention, a range for the surface roughness $R_a$ or $S_a$ of at least 0.1 μm up to a maximum of 10.0 μm, preferably at least 0.4 μm up to a maximum of 4.0 μm, particularly preferably at least 0.5 μm up to a maximum of 2.0 μm can be set on at least one surface of the strip through positioning of the control roll and adjustment of the entry angle b. It has been found that the aforementioned ranges for the roughness $R_a$ or $S_a$ are advantageous for the forming behaviour of a metal sheet manufactured from the strip. Preferably, a structure with the same roughness, that is to say with approximately identical values for $R_a$ or $S_a$, is applied to both sides of the strip.

The roughness values of the strip can in particular be monitored during rolling by means of a measuring device. An optical measuring device is preferably used which permits contact-free measurement and provides sufficient precision for the aforementioned roughness values.

In a further embodiment of the method according to the invention, at least one work roll has an EDT surface structure or an EBT surface structure. A surface structure produced by means of "Electrical Discharge Texturing" (EDT) permits a high number of peaks in the surface profile. With "Electron Beam Texturing" (EBT), depressions which are distributed over the surface in a controlled manner can be provided. Surface structures in the work rolls produced using both methods are highly suitable for embossment rolling. Further, "Shot Blasting Texturing" (SBT) can also be used for surface structuring. Also conceivable is a structured chrome layer as surface structure or a laser-textured surface.

In a further embodiment of the method according to the invention, a strip consisting of aluminium or an aluminium alloy is used. In particular, an aluminium alloy of the type AA5xxx or AA6xxx is used. Other preferred types of aluminium alloy are AA6014, AA6016, AA6022, AA6111 or AA6060 as well as AA5005, AA5005A, AA5754 or AA5182. The aforementioned alloys are highly suitable for applications with high forming requirements combined with high strength. The forming properties of the strips produced from the alloys can be further improved through the method according to the invention.

According to a second teaching of the present invention, the aforementioned technical problem is solved through an apparatus for rolling a strip, in particular for carrying out the method according to the invention, in that a control roll is arranged before the rolling gap of the roll stand, in the direction of transport, and means for positioning the control roll relative to the pass line of the strip are provided.

The entry angle β can thereby be changed by means of the means for positioning the control roll relative to the pass line and in this way the embossing of the surface structure onto the strip controlled. Changing the entry angle β through means for positioning the control roll represents a simple and process-reliable possibility for controlling the surface structure of a strip in an roll-embossing pass. The roll-embossing pass can thereby be adapted in terms of the desired surface structure by changing the entry angle β without changing the roll stand, in particular without needing to change the work rolls. In particular, despite a work roll being affected by wear, the rolling pattern can be kept uniform by changing the entry angle β by means of the control roll. Also, simple work rolls without a bending apparatus can be used to change the rolled section.

In one embodiment of the apparatus according to the invention a guide roll is positioned before the control roll in the direction of transport of the strip. In combination with the control roll, at least one guide roll offers more possibilities and variability of the path of the strip in order to adjust the entry angle β.

In particular, means for positioning the at least one guide roll relative to the pass line are provided. This allows the at least one guide roll also to be positioned largely independently of the desired entry angle β, since the entry angle β can primarily be adjusted through the means for positioning the control roll.

Further, means for positioning the work roll or for changing the pass line can also be provided, which further increases the variability of the apparatus with respect to the path of the strip and the entry angle β.

In a further embodiment of the apparatus according to the invention, the means for positioning the control roll allow an entry angle β of between +/−10°, +/−5°, +/−3° or preferably a maximum of between +/−2α. The position of the control roll can preferably be varied in 0.1° increments, particularly preferably in 0.05° increments of the entry angle β, so that a very precise influencing of the surface roughness of the upper side and underside of the strip can take place. This has proved advantageous, in particular in combination with two-high roll stands providing only a small angle of bite. The aforementioned angle range +/−10°, +/−5° or +/−3° for the entry angle β makes an adjustment range that is sufficient to influence the surface structure of the strip possible. If limited to an angle range of +/−5°, +/−3° or +/−2α it is possible to realise particularly small increments for the adjustment of the angle in a simple way.

In a further embodiment of the apparatus according to the invention, a two-high roll stand is provided as roll stand, in particular a two-high roll stand with two work rolls with the same diameter. The provision of the control roll before the two-high roll stand means that the rolling pattern on the strip can primarily be controlled through the means for adjusting the control roll, even at small angles of bite. More complicated, maintenance-intensive and expensive four-high and six-high roll stands can be dispensed with.

In a further embodiment of the apparatus according to the invention, at least one measuring device is provided for measurement of the surface roughness of at least one surface of the strip. Preferably, an optical measuring device is used which permits contact-free measurement and provides sufficient precision for the aforementioned roughness values. The measuring device can in particular be arranged after the roll stand, in the direction of transport of the strip, in order to the measure the rolling pattern of the roll-embossing pass.

In particular, at least one control means is provided, by means of which the positioning of the control roll, optionally the positioning of the at least one guide roll, can be controlled depending on the measurement of the surface roughness of the at least one surface of the strip. The control means can thereby evaluate the measured surface roughness and change the entry angle β by positioning the control roll. This allows the rolling pattern to be monitored and controlled during the rolling operation.

BRIEF DESCRIPTION OF THE SEVERAL VIEWS OF THE DRAWING

For further embodiments and advantages of the apparatus according to the invention, reference is made to the explanations above as well as to the dependent claims of the method according to the invention, as well as to the drawing. The drawing shows:

DETAILED DESCRIPTION OF THE INVENTION

Figure 1A:
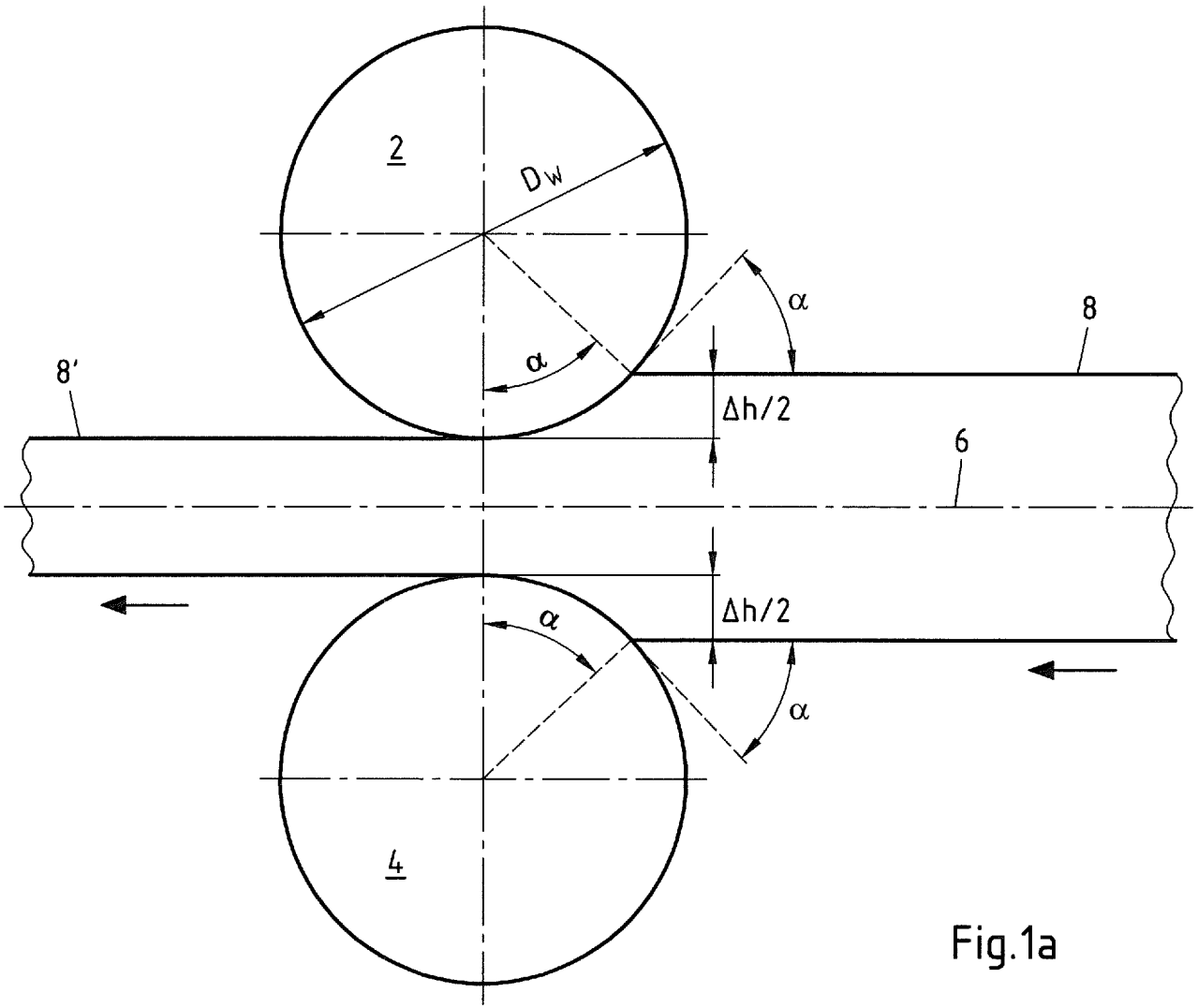
FIGS. 1*a* and 1*b* show schematic views of the geometry during rolling.

FIG. 1*a* shows a first schematic view of the geometry during rolling. A rolling gap is formed between a first (upper) work roll 2 and a second (lower) work roll 4 through which a pass line 6 is given. The pass line 6 runs through the neutral phase of the strip and is perpendicular to the connecting plane of the axes of rotation of rolls 2 and 4. A strip 8 passes through the rolling gap, being deformed by the work rolls 2, 4 into a strip 8' of reduced thickness. Here, Δh is the difference between the thickness of the strip 8 before rolling and the thickness of the strip 8' after rolling in mm (pass reduction).

The work rolls 2, 4 are in contact with the strip with an bite angle α. As indicated in FIG. 1*a*, the bite angle α is the angle between the connecting line between the two axes of the work rolls 2, 4 and the connecting line from one axis to the point of contact with the surface of the strip. The bite angle is defined through $$\alpha=\arccos\,[1-(\Delta h/D_W)]$$

where $D_W$ is the diameter of a work roll 2, 4 in mm. In the example shown in FIG. 1*a*, the diameters $D_W$ of the work rolls 2, 4 are identical and thus have the same bite angle α.

The strip 8 in FIG. 1*a* also runs within and parallel to the pass line 6, which means that the entry angle β=0°. The contact angle between the surface of the strip 8 and the tangent of the surface of both work rolls 2, 4 is thus equal to the bite angle α.

Figure 1B:
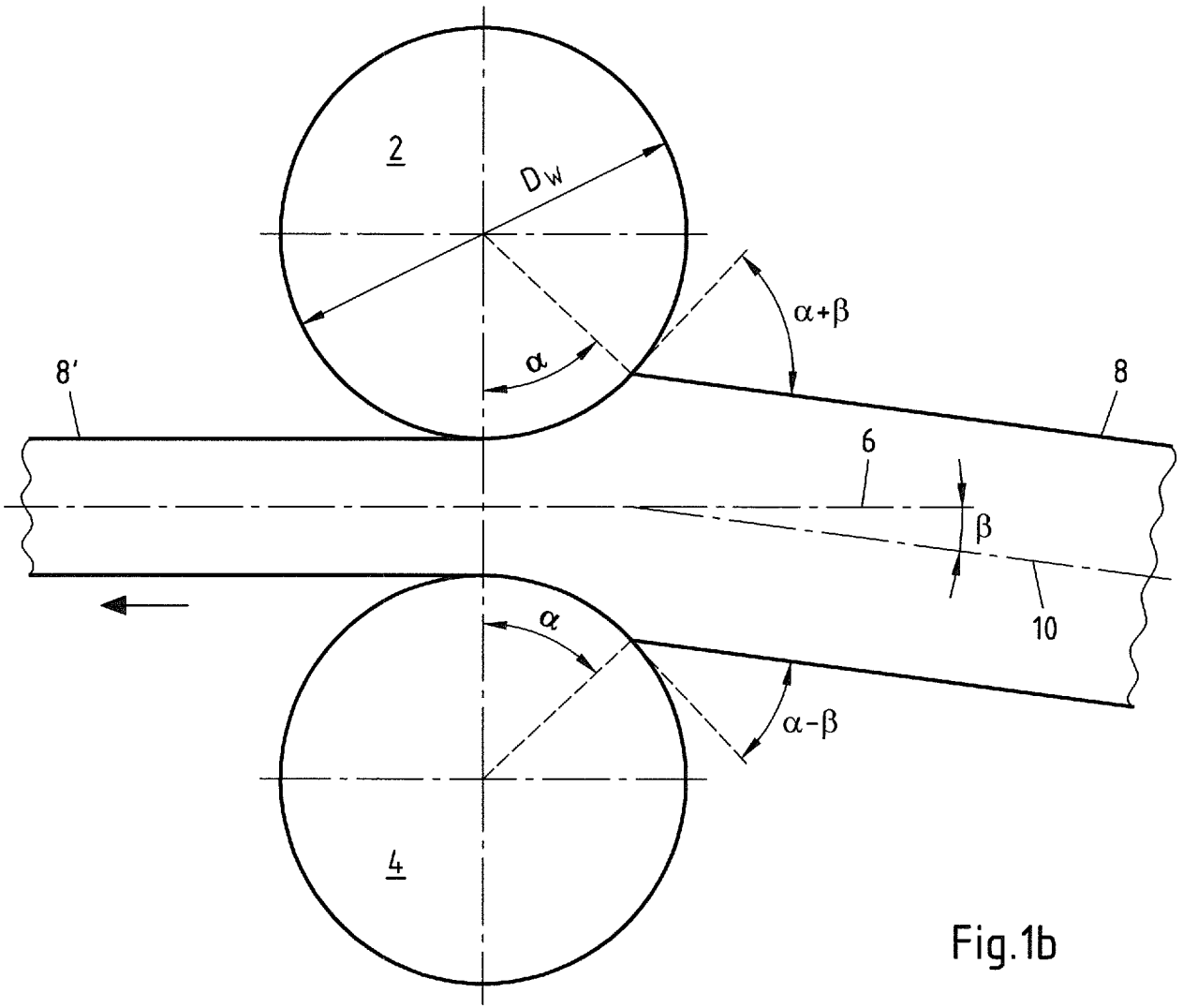

FIG. 1*b* shows a second schematic view of the geometry during rolling, wherein there is an entry angle β≠0° between the path of the strip 8 and the pass line. This is drawn in, in FIG. 1*b*, between the pass line 6 and the centre line 10 of the strip 8. The entry angle β≠0° has the effect that the contact angle between the surface of the strip 8 and the tangent of the surface of the work rolls 2, 4 is different for both sides. In FIG. 1*b*, the upper work roll 2 has a contact angle of α+β and the lower work roll 4 a contact angle of α−β.

If a lubricant is used, the lubricant feed in the rolling gap is dependent on the contact angle α+β or α−β between the tangent of the surface of the respective work roll 2, 4 with the surface of the strip 8. The contact angles of the work rolls 2, 4 and thus the hydrodynamic lubricant feed can be changed through an adjustment of the entry angle β. In particular, the rolling pattern of the upper side and underside of the strip 8' can be influenced through an adjustment of the entry angle β.

If the entry angle β exceeds the bite angle α then the strip lies tangentially against the work roll 4. In this case a further increase in the entry angle β no longer results in any significant change in the lubricant feed on the work roll 4.

Figure 2A:
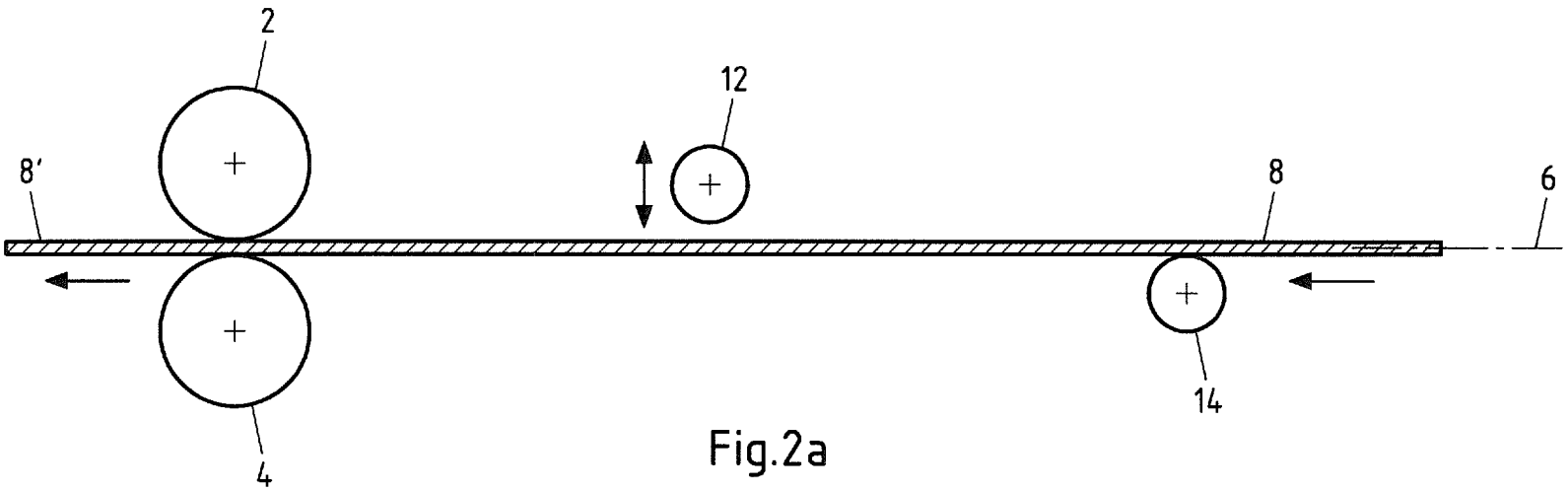
FIGS. 2*a* to 2*d* show schematic views of the method according to the invention and the apparatus according to the invention.

FIG. 2*a* shows a first schematic view of the method according to the invention and the apparatus according to the invention. A roll stand is represented here in simplified form through the work rolls 2, 4, wherein at least one of the work rolls 2, 4 has a structured surface. A control roll 12 with means for positioning relative to the pass line 6 is arranged before the work rolls 2, 4 in the direction of transport of the strip. At least one guide roll 14 is provided before this in the direction of transport of the strip.

In FIG. 2*a*, the control roll 12 is positioned such that the control roll 12 does not touch the strip 8. The strip 8 thus runs within and parallel to the pass line 6 and the entry angle is β=0°. This represents a situation analogous to FIG. 1*a*, in which both contact angles of the work rolls 2, 4 with the surface of the strip 8 are equal to the bite angle α.

Figure 2B:
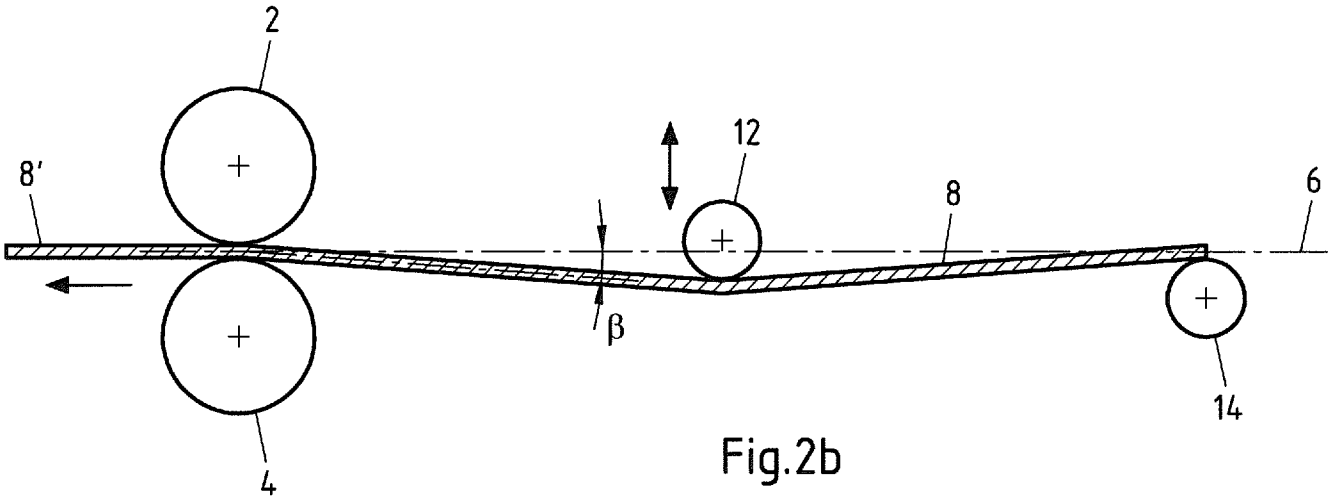

In contrast, in FIG. 2*b* the control roll 12 is positioned, via the means for positioning, such that the control roll 12 touches the strip 8, deflects it and thus creates an entry angle β≠0° between the strip 8 and the pass line 6. This situation is comparable with that in FIG. 1*b*.

By changing the entry angle β, the contact angle of the work rolls 2, 4 and thus in particular the hydrodynamic lubricant feed to the respective work roll 2, 4 can be changed. Thus, the rolling pattern on the upper side and underside of the strip 8' or the surface structure of the rolled strip 8' can be controlled by changing the entry angle β via the means for positioning the control roll 12.

Figure 2C:
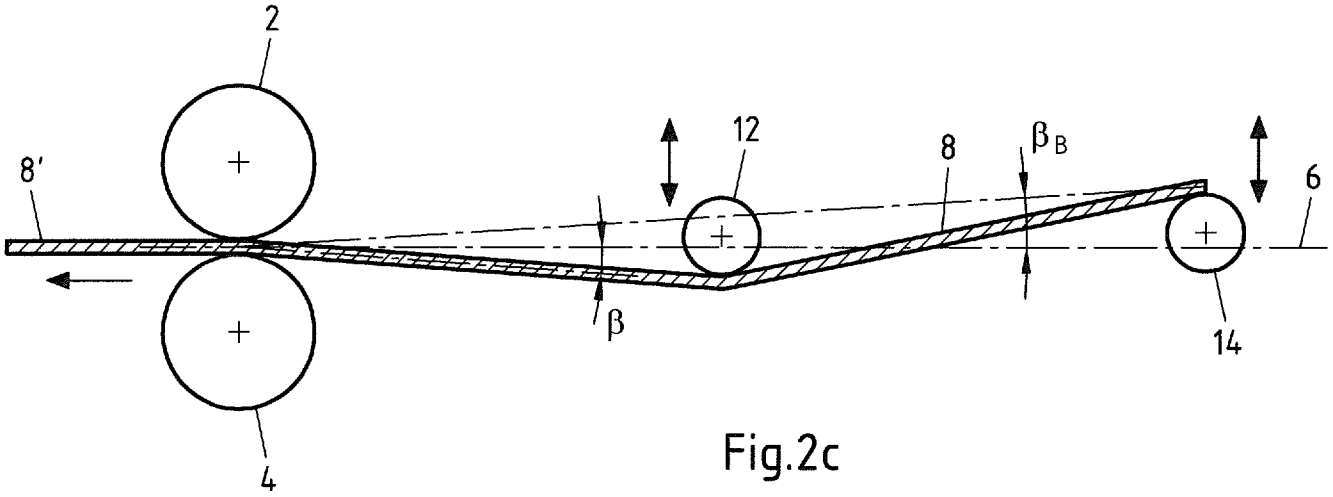

FIG. 2*c* shows a further embodiment of the method according to the invention and the apparatus according to the invention in a further schematic view. Means for positioning the at least one guide roll 14 relative to the pass line 6 are also provided here.

Here, the at least one guide roll 14 is positioned such that an entry angle $\beta_B$ would be set without the control roll 12 coming into contact with the strip 8. Through the positioning of the control roll 12, an entry angle β is set, wherein the difference between the entry angles β and $\beta_B$ is at least 0.5°, preferably 1.0°.

A positioning of control roll 12 and guide roll 14 of this type ensures that the control roll 12 has sufficient traction on the strip 8 in order to avoid any slipping between the strip 8 and the control roll 12. Consequently, undesired grinding or scratching effects on the surface of the strip 8 caused by the control roll 12 are avoided.

Figure 2D:
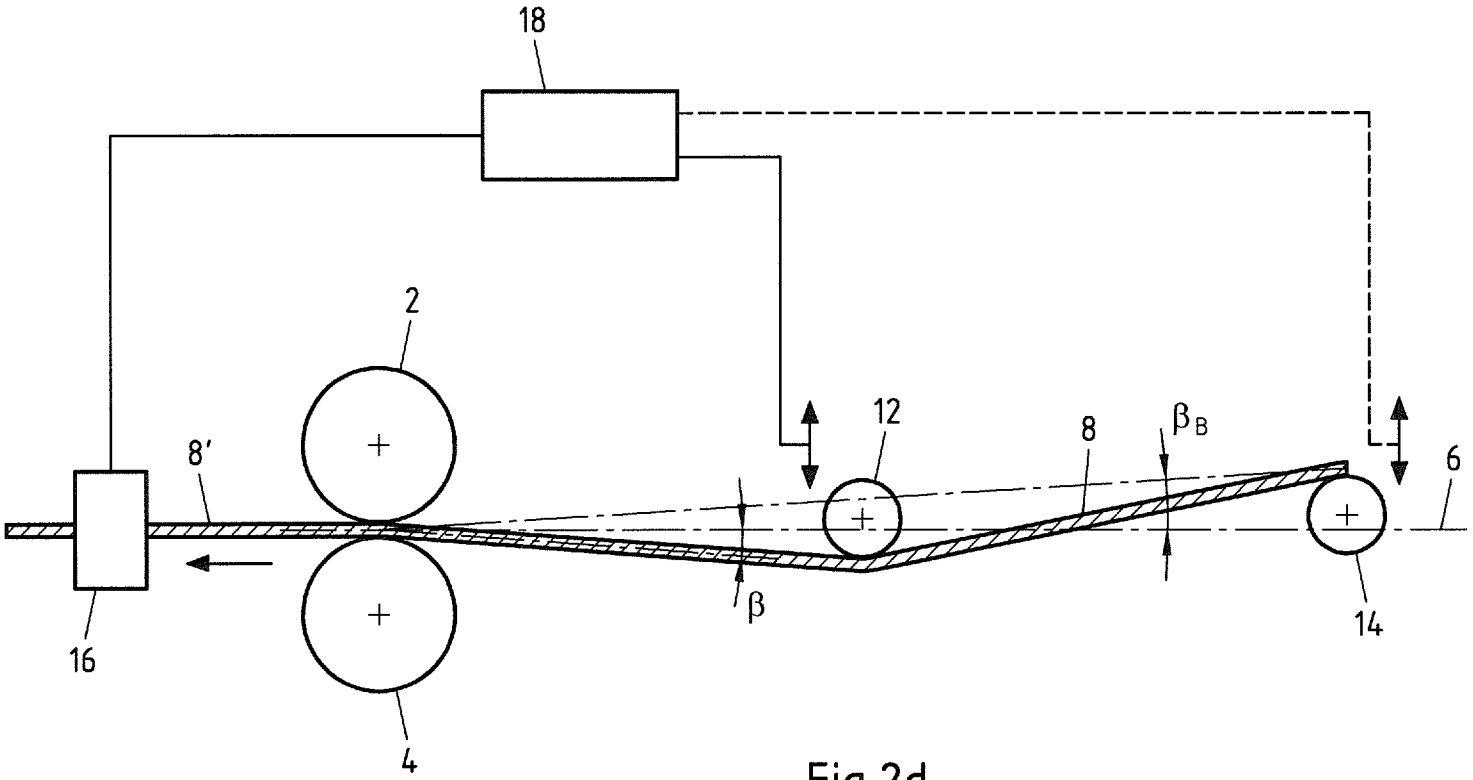

FIG. 2*d* shows a further embodiment of the method according to the invention and the apparatus according to the invention in a further schematic view. A measuring device 16 is provided here for measurement of the surface roughness of at least one surface of the strip 8'. The rolling patterns can be monitored by means of the measuring device 16. The measuring device 16 can pass on the measured values to a control means 18. The control means 18 hereby exerts influence on the means for positioning the control roll 12 on the basis of the measured values from the measuring device 16. Therefore, the control means 18 can be used to control the surface roughness of the strip 8' during rolling. Optionally, the control means 18 can also control the means for positioning the at least one guide roll 14.

Figure 3:
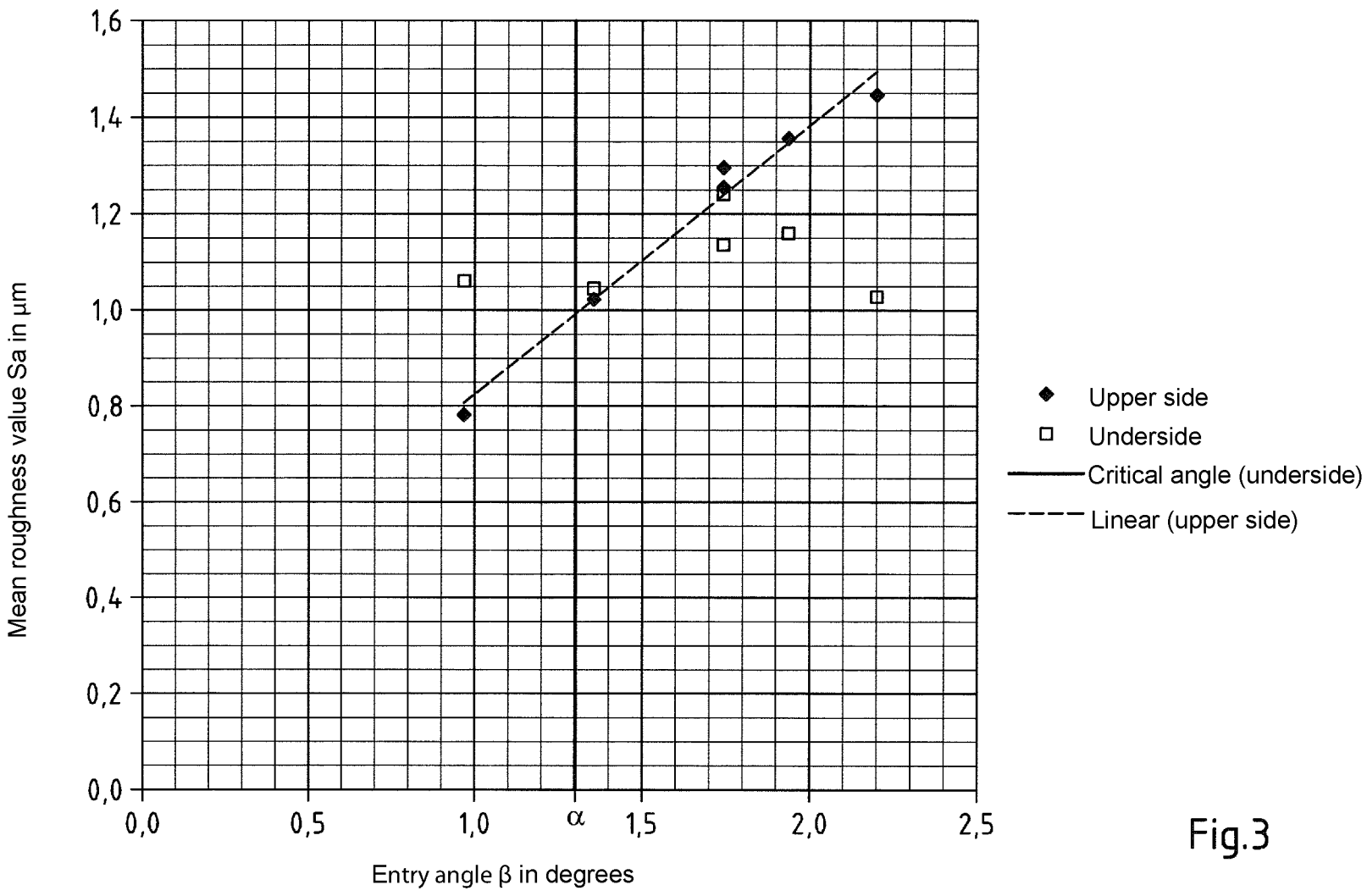
FIG. 3 show measured mean roughness values $S_a$ depending on the entry angle.

FIG. 3 shows measured mean roughness values $S_a$ depending on the entry angle β from a test series. Here, an aluminium alloy strip of the alloy type AA6016 with a thickness of 2.4 mm was rolled in a roll stand. The bite angle α of the embossing roll stand was around 1.3° during the tests.

The strips were rolled with different entry angles β, which were set by means of the control roll. For entry angle β>α=1.3°, the bite angle α of the lower work roll was exceeded. No great variation was therefore observed in the mean roughness value $S_a$ for the underside of the strip. Rather, the underside of the strip lay tangentially against the surface of the lower work roll, which meant that a constant rolling pattern was produced practically independently of the entry angle β. However, for the upper side, a surprisingly high dependence of the mean roughness value Sa on the entry angle β was observed. It was found that by changing the entry angle β through the positioning of the control roll a wide range of different roughnesses can be achieved on the upper side of the strip and the respective mean roughness values $S_a$ can be specifically set. The dependence of the mean roughness value $S_a$ on the entry angle β within the measured range is approximately linear.

Figure 4:
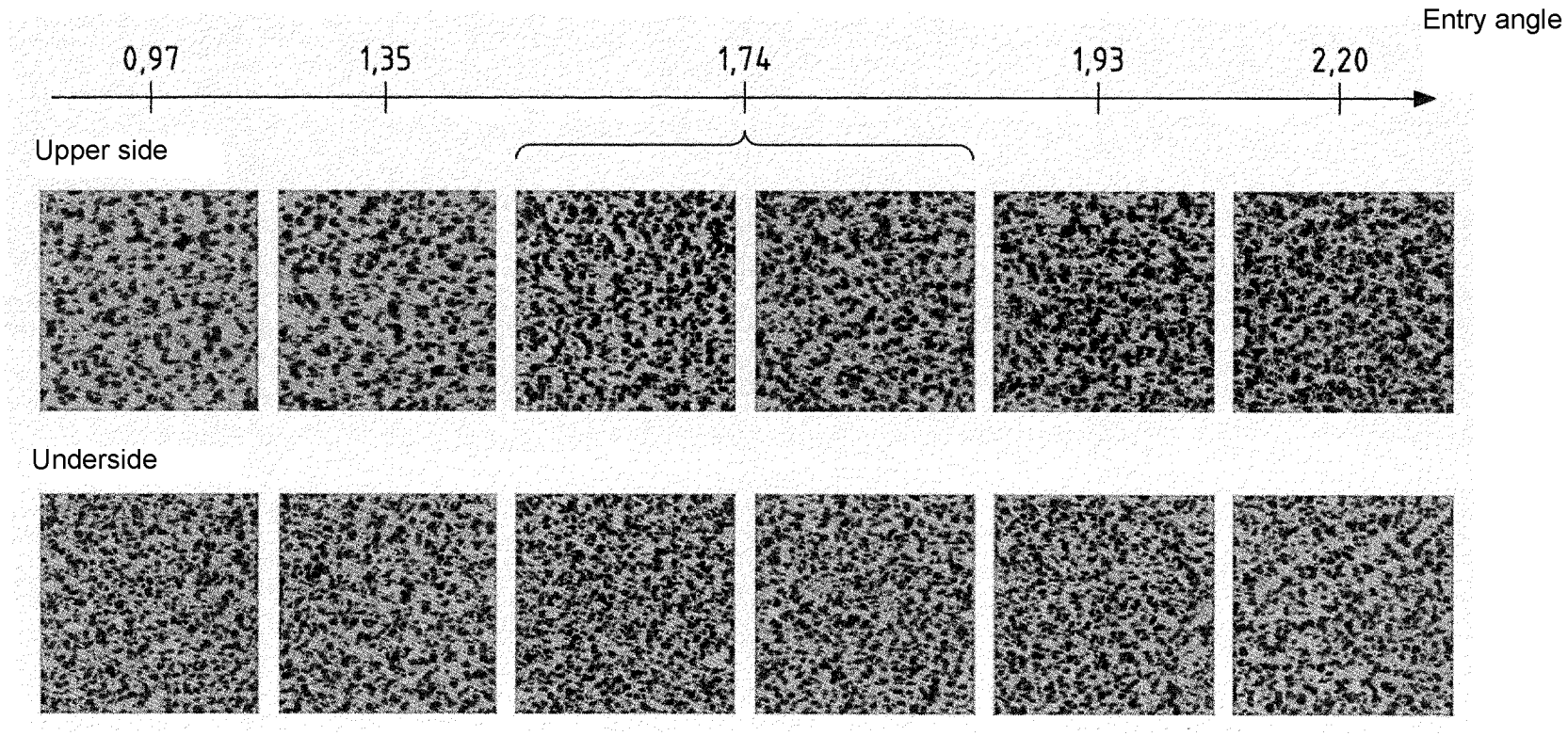
FIG. 4 shows surface topographies of the upper side and underside of strips rolled according to the invention depending on the entry angle.

FIG. 4 shows surface topographies of the upper side and underside of strips rolled according to the invention as a function of the entry angle β from the same test series as shown in FIG. 3. Here too it can be seen that while, due to the exceeding of the bite angle α, the topography of the underside only varies slightly with the entry angle α, the topography of the upper side can be controlled very effectively by adjusting the entry angle β by means of the control roll. For example, the control roll can be used, in a reliable manner, to set the same roughness on both sides of the strip.

The control roll can also be used to react to a changing of, or wear on, the work rolls. In this test series, following an increase of the entry angle β from 0.97° to 2.20°, the entry angle β=1.74° was set again. As can be seen in FIGS. 3 and 4, a slightly changed topography or a slightly changed roughness was observed in comparison with the previous test at β=1.74°. This was probably attributable to an accretion of material or a soiling of the work rolls. However, in such a case a uniform rolling pattern can be achieved again simply by once again adjusting the entry angle β, without the work rolls needing to be reconditioned or replaced.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. Method for roll-embossing a strip, comprising the steps of:

providing a roll stand comprising a first work roll and a second work roll, wherein at least one of the first work roll or the second work roll comprises a surface structure to impress a rolling pattern into the strip, wherein a rolling gap with a pass line is defined between the first work roll and the second work roll;

arranging a control roll before the rolling gap of the work rolls in a rolling direction;

guiding the strip into the rolling gap of the roll stand via the control roll at an entry angle β relative to the pass line;

controlling embossing of the surface structure of the work roll on the strip through selection of the entry angle β depending on a positioning of the control roll relative to the pass line; and setting the entry angle β within an adjustment range of +/−2α, where α is a bite angle of the first work roll or the second work roll in a given rolling pass, for which:

$$\alpha=\arccos\,[1-(\Delta h/D_W)],$$

where Δh is a difference between a thickness of the strip before rolling and a thickness of the strip after rolling in mm (pass reduction) and $D_W$ is a diameter of the work roll in mm.

2. Method according to claim 1,
characterised in that
at least one guide roll is used through which the strip runs before the control roll.

3. Method according to claim 2,
characterised in that
the at least one guide roll is positioned such that an entry angle $\beta_B$ is set by the at least one guide roll if the control roll does not touch the strip and
the entry angle β is set through the positioning of the control roll, so that the difference between the entry angles β and $\beta_B$ is at least 0.5°.

4. Method according to claim 2,
characterised in that
the at least one guide roll is positioned such that an entry angle $\beta_B$ is set by the at least one guide roll if the control roll does not touch the strip and
the entry angle β is set through the positioning of the control roll, so that a difference between the entry angles β and $\beta_B$ is at least 1.0°.

5. Method according to claim 1,
characterised in that
a two-high roll stand is used as the roll stand.

6. Method according to claim 1,
characterised in that
a surface roughness of at least one surface of the strip is controlled through the positioning of the control roll during rolling in combination with a measurement of the surface roughness of the strip.

7. Method according to claim 1,
characterised in that
during the rolling pass a relative change in a thickness of the strip of less than 10%.

8. Method according to claim 1,
characterised in that
a range for a surface roughness $R_a$ or $S_a$ of at least 0.1 μm up to a maximum of 10.0 μm can be set on at least one surface of the strip through positioning of the control roll.

9. Method according to claim 1,
characterised in that
at least one work roll has an EDT surface structure, an EBT surface structure, a structured chrome layer or a laser-textured surface.

10. Method according to claim 1,
characterised in that
the strip consists of aluminium or an aluminium alloy.

11. Method according to claim 1,
characterised in that
a two-high roll stand with two identical work rolls is used as the roll stand.

12. Method according to claim 1,
characterised in that during the rolling pass a relative change in a thickness of the strip of 1-6% takes place.

13. Method according to claim 1,
characterised in that
a range for a surface roughness $R_a$ or $S_a$ of at least 0.4 μm up to a maximum of 4.0 μm can be set on at least one surface of the strip through positioning of the control roll.

14. Method according to claim 1,
characterised in that
a range for a surface roughness $R_a$ or $S_a$ of at least 0.5 μm up to a maximum of 2.0 μm can be set on at least one surface of the strip through positioning of the control roll.

15. Method according to claim 1,
characterised in that
the strip consists of an aluminium alloy of type AA5xxx or AA6xxx.

* * * * *